US008427406B2

(12) United States Patent
Lee et al.

(10) Patent No.: US 8,427,406 B2
(45) Date of Patent: Apr. 23, 2013

(54) ORGANIC LIGHT EMITTING DISPLAY AND DRIVING METHOD THEREOF

(75) Inventors: Jae-Sung Lee, Yongin-si (KR); Chang-Hoon Lee, Yongin-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 858 days.

(21) Appl. No.: 11/890,050

(22) Filed: Aug. 3, 2007

(65) Prior Publication Data

US 2008/0074361 A1 Mar. 27, 2008

(30) Foreign Application Priority Data

Sep. 26, 2006 (KR) ..... 10-2006-0093762

(51) Int. Cl.
*G09G 3/32* (2006.01)

(52) U.S. Cl.
USPC ..... 345/83; 345/77

(58) Field of Classification Search ..... 345/76, 345/77, 84, 204, 102, 82, 83; 315/154; 348/68
See application file for complete search history.

(56) References Cited

U.S. PATENT DOCUMENTS

| | | | | |
|---|---|---|---|---|
| 7,294,970 | B2 * | 11/2007 | Yang | 315/158 |
| 7,657,115 | B2 * | 2/2010 | Chen | 382/266 |
| 7,692,734 | B2 * | 4/2010 | Fujita et al. | 349/61 |
| 2002/0011978 | A1 * | 1/2002 | Yamazaki et al. | 345/87 |
| 2004/0155593 | A1 * | 8/2004 | Kim et al. | 315/158 |
| 2005/0057191 | A1 * | 3/2005 | Jo et al. | 315/291 |
| 2005/0127278 | A1 * | 6/2005 | Cok | 250/214 AL |
| 2005/0140641 | A1 * | 6/2005 | Kim et al. | 345/102 |
| 2006/0152737 | A1 | 7/2006 | Carlson et al. | |
| 2006/0192215 | A1 * | 8/2006 | Hayashi et al. | 257/80 |
| 2006/0244697 | A1 * | 11/2006 | Lee et al. | 345/77 |
| 2007/0126934 | A1 * | 6/2007 | Miura et al. | 348/655 |
| 2007/0153117 | A1 * | 7/2007 | Lin et al. | 348/362 |

FOREIGN PATENT DOCUMENTS

| | | | |
|---|---|---|---|
| KR | 1020040078438 | | 9/2004 |
| KR | 10-2004-0086973 | A | 10/2004 |
| KR | 1020050058898 | | 6/2005 |
| KR | 10-2005-0119559 | A | 12/2005 |
| TW | I264691 | B | 10/2006 |

OTHER PUBLICATIONS

Notice of Allowance, issued by KIPO, dated Apr. 16, 2008, 1 page.
Korean Office Action issued in Korean Patent Application No. 9-5-2007-044855447, on Aug. 20, 2007.

* cited by examiner

*Primary Examiner* — Chanh Nguyen
*Assistant Examiner* — Pegeman Karimi
(74) *Attorney, Agent, or Firm* — Knobbe Martens Olson & Bear, LLP

(57) ABSTRACT

An organic light emitting display and a method for driving the same is disclosed. A pixel portion includes a plurality of pixels, which receive a plurality of scan signals, a plurality of emission control signals, and a plurality of data signals to display images. A data driver for generating and transferring the plurality of data signals to the pixel portion using video data. A scan driver transfers the plurality of scan signals and the plurality of emission control signals to the pixel portion. An optical sensor controls luminance of the pixel portion according to peripheral (or ambient) light. A current controller limits an electric current flowing through the pixel portion according to a sum of the video data input during a frame when the peripheral light sensed by the optical sensor has luminance equal to or greater than a predetermined value in order to control the luminance.

11 Claims, 5 Drawing Sheets

ORGANIC LIGHT EMITTING DISPLAY AND DRIVING METHOD THEREOF

CROSS-REFERENCE TO RELATED APPLICATIONS

This application claims the benefit of Korean Patent Application No. 2006-93762, filed on Sep. 26, 2006, in the Korean Intellectual Property Office, the disclosure of which is incorporated herein by reference.

BACKGROUND OF THE INVENTION

1. Field

The field relates to an organic light emitting display, and a method for driving the display, and more particular to an organic light emitting display, which controls luminance corresponding to the brightness of peripheral (or ambient) light by adjusting an emission time and gamma compensation and a method for driving the display.

2. Discussion of Related Technology

In a flat panel display, a number of pixels are arranged on a substrate in the matrix, and is referred to as 'display region'. A scan line and a data line are connected to each pixel. A data signal is selectively applied to a pixel to display images.

Flat panel displays are classified into either an active matrix type or a passive matrix type according to construction. Since each pixel is selected and emits light according to resolution, contrast, and operation speed in the active matrix type display, the pixel array is the main current sink of the display.

Such a flat panel display has been used as a display device of a portable information terminal such as a personal computer, a portable telephone, a PDA (personal digital assistant) or a monitor for a variety of information devices. An LCD (liquid crystal display) using a liquid crystal panel, an organic light emitting display using an organic light emitting diode, and a PDP (plasma display panel) using a plasma panel have been known as examples of such a flat panel display.

Recently, various flat plate displays with reduced weight and volume when compared with cathode ray tubes (CRT) have been developed. In particular, an organic light emitting display device having excellent emission efficiency, luminance, viewing angle, and high speed response, has been used.

FIG. 1 is a view showing a conventional organic light emitting display. With reference to FIG. 1, the conventional organic light emitting display includes a pixel portion 10, a data driver 20, a scan driver 30, and a power supply unit 40.

A plurality of pixels 1 are arranged at the pixel portion 10. Each of the pixels 1 includes an organic light emitting diode (not shown). N scan lines S1, S2, S3, . . . , Sn−1, Sn, and m data lines D1, D2, Dm−1, and Dm are arranged in a column direction and a row direction at the pixel portion 10, respectively. The N scan lines S1, S2, S3, . . . , Sn−1, Sn transfer a scan signal, and the m data lines D1, D2, Dm−1, and Dm transfers a data signal. The N scan lines S1, S2, S3, . . . , Sn−1, Sn receives a voltage of a first power source ELVDD and is driven in response thereto, and the m data lines D1, D2, Dm−1, and Dm receive a voltage of a second power source ELVSS and is driven in response thereto. Accordingly, in the pixel portion 10, an organic light emitting diode emits light according to the scan signal, the data signal, the voltage of the first power source ELVDD, and the voltage of the second power source ELVSS in order to display images.

The data driver 20 applies a data signal to the pixel portion 10. The data driver 20 is connected to data lines D1, D2, . . . , Dm−1, Dm, and provides the data signal to the pixel portion 10.

The scan driver 30 sequentially outputs a scan signal. That is, the scan driver 30 is connected to the scan lines S1, S2, S3, . . . , Sn−1, Sn, and transfers the scan signal to each row of the pixel portion 10. The data signal from the data driver 20 is applied to each row of the pixel portion to which the scan signal is transferred to display images. When all rows are selected, one frame is completed.

The power supply unit 40 transfers the voltage of a first power source ELVDD and the voltage of a second power source ELVSS to the pixel portion 10, so that an electric current corresponding to the data signal flows through each pixel 10 according to a voltage difference between the first power source ELVDD and a second power source ELVSS. Here, the second power source ELVSS has a voltage less than that of the first power source ELVDD.

As mentioned above, in the conventional organic light emitting display, when images are displayed with a predetermined luminance in an environment of high levels of peripheral light, it is perceived as darker than it should be. Accordingly, a user perceives the images as being too dark. Alternatively, when luminance of the peripheral light is lower, the image is perceived as being too bright. Accordingly, when the peripheral light varies, it may be difficult to recognize images.

Furthermore, in the organic light emitting display, when high luminance is generated, a large electric current flows through the pixel portion 10. In contrast to this, when low luminance is generated, a small electric current flows through the pixel portion 10. When the high luminance is generated, a large electric current flows through the pixel portion 10, and a large load is subjected to the power supply unit 40. Consequently, there is demand for the power supply unit to have a high output capability.

In addition, when there are many regions generating high luminance, the contrast is reduced, thereby deteriorating image quality.

Summary of Certain Inventive Aspects

BRIEF DESCRIPTION OF THE DRAWINGS

These and/or other aspects and advantages will become apparent and more readily appreciated from the following description, taken in conjunction with the accompanying drawings of which.

DETAILED DESCRIPTION OF CERTAIN INVENTIVE EMBODIMENTS

Hereinafter, embodiments will be described with reference to the accompanying drawings. Here, when one element is connected to another element, one element may be not only directly connected to another element but also indirectly connected to another element via another element.

Figure 1:
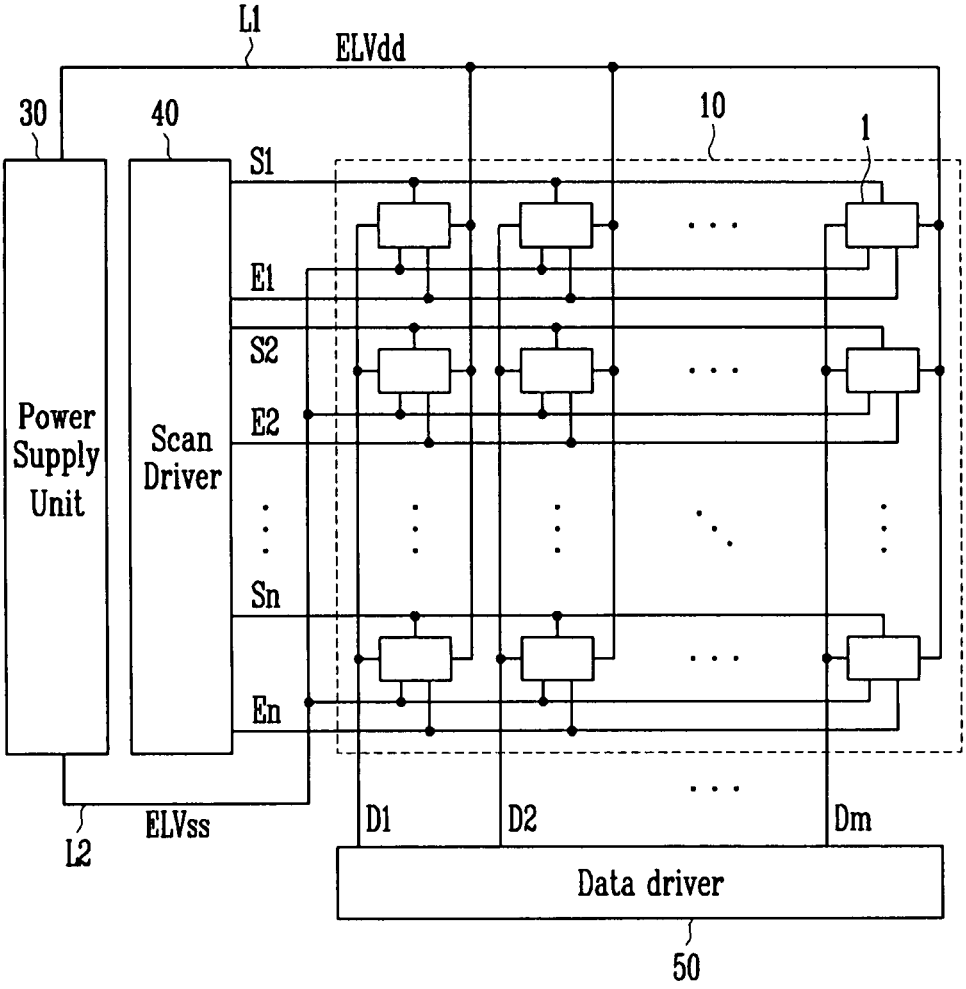
FIG. 1 (PRIOR ART)
FIG. 1 is a block diagram view showing a conventional organic light emitting display.
Figure 2:
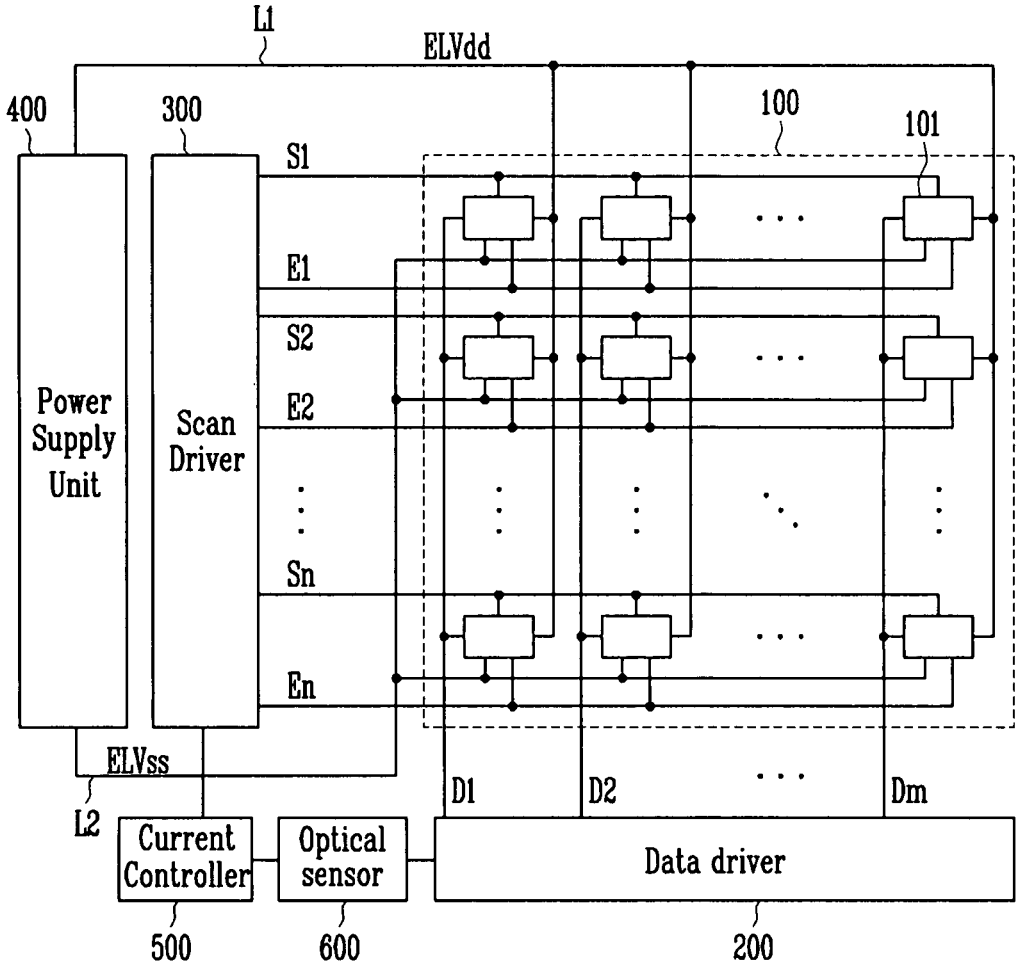
FIG. 2 is a block diagram view showing a construction of an organic light emitting display according to an embodiment.

FIG. 2 is a view showing a construction of an organic light emitting display according to an embodiment. With reference to FIG. 2, the organic light emitting display includes a pixel portion 100, a data driver 200, a scan driver 300, a power supply unit 400, a current controller 500 and an optical sensor 600.

The pixel portion 100 includes a plurality of pixels 101, a first power line L1, and a second power line L2. The plurality of pixels 101 are electrically coupled to n scan lines S1, S2, . . . , Sn and emission control lines E1, E2, . . . , En arranged in a row direction, and m data lines D1, D2, . . . , Dm in a column direction. The first power line L1 supplies a first power source ELVdd to the pixel portion 100. The second power line L2 supplies a second power ELVss to the pixel portion 100.

The data driver 200 is connected to the plurality of data lines D1, D2, Dm. The data driver 200 receives an image signal and generates a data signal to transfer a compensated data signal to the data lines D1, D2, . . . , Dm corresponding to a control signal output from the optical sensor 500.

The scan driver 300 supplies a scan signal and an emission control signal to the scan lines S1, S1, . . . , Sn and the emission control lines E1, E2, . . . , En, respectively. The data signal is transferred to a row of the pixel portion 100 selected by the scan signal to determined an emission time of a pixel by a pulse width of the emission control signal. Further, the scan driver 300 adjusts a pulse width of the emission control signal by driving the current controller 600 so as to control an amount of an electric current flowing through the pixel portion 100. Here, the scan driver 400 generates and outputs the emission control signal. However, the emission control lines E1, E2, . . . , En may be connected a separate driver and transfer the emission control signal to the pixel portion 100.

The power supply unit 400 supplies the first power source ELVdd to the pixel portion 100 through the first power line L1, and supplies the second power source ELVss thereto through the second power line L2.

The current controller 500 limits an amount of an electric current flowing through the pixel portion 100 based on a sum of image signals inputted thereto during a frame. That is, when the sum of the image signals is large, the current controller 500 allows the amount of an electric current flowing through the pixel portion 100 to have a large value. In contrast to this, when the sum of the image signals is small, the current controller 500 limits the amount of an electric current flowing through the pixel portion 100 to have a small value. If the sum of the image signals is large an image generated during the frame has high overall brightness. In contrast to this, what the sum of the image signals is small an image generated during the frame has low overall brightness. Accordingly, when a sum of the images is large, the current controller 500 limits luminance.

The optical sensor 600 generates a sensing signal corresponding to the brightness of peripheral light to be used to control luminance of the pixel portion 100 according to the peripheral light. In this embodiment, the optical sensor 600 can control the luminance with four levels of outer light, inner light, a dark state, and the darkest state. Accordingly, the luminance is controlled to be one of the four levels. However, the peripheral light may be divided into more or fewer levels.

Furthermore, only when the peripheral light sensed by the optical sensor 600 is either the outer light or the inner light, does the current controller 500 operate to limit the electric current amount according to the sum of gradations of the input image signals during the frame. When the peripheral light is in the dark state or the darkest state, the luminance of the pixel portion 100 is lowered. When the electric current is limited, the luminance of the pixel portion 100 is reduced. Accordingly, it may be unnecessary to limit the luminance.

Figure 3:
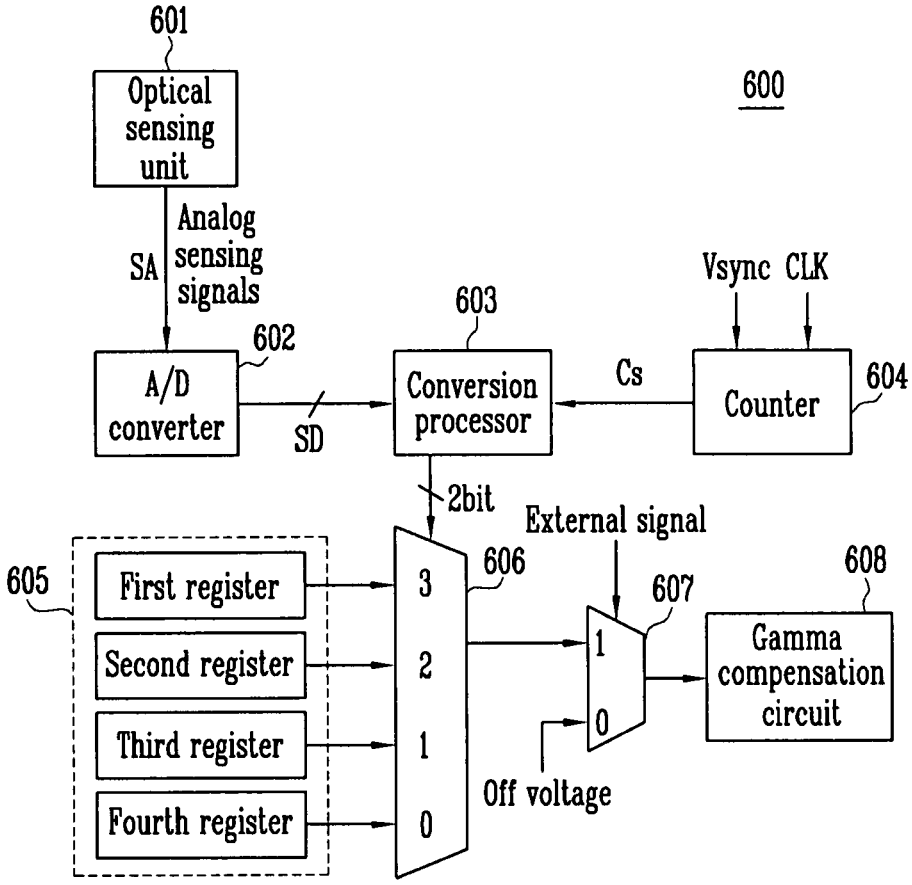
FIG. 3 is a block diagram view showing an example of an optical sensor used in the organic light emitting display shown in FIG. 2.

FIG. 3 is a view showing an example of an optical sensor used in the organic light emitting display shown in FIG. 2. Referring to FIG. 3, the optical sensor 600 of the present invention includes an optical sensing unit 601, an A/D converter 602, a conversion processor 603, a counter 604, a plurality of registers 605, a first selector 606, a second selector 607, and a gamma compensation circuit 608.

The optical sensing unit 601 measures brightness of peripheral light, and determines the peripheral light to be an outer light, an inner light, a dark state, and the darkest state according to its brightness, and outputs analog sensing signals corresponding to the respective brightness levels.

The A/D converter 602 compares the analog sensing signals from the optical sensor 601 with a reference voltage, and outputs corresponding digital sensing signals. Here, the A/D converter 512 compares the analog sensing signals with the reference voltage and sets digital sensing signals according to the comparison result.

The conversion processor 603 maintains the analog sensing signals from the optical sensor 610 while the counter 604 is counting to a number. That is, when the conversion processor 603 receives a signal from the counter 604, it outputs the analog sensing signals from the digital sensing signals from the A/D converter 602, and maintains sensing signals outputted during the frame period. Further, when a next frame period comes, the conversion processor 603 resets the sensing signals maintained during the previous frame period, and outputs and maintains the sensing signals from the A/D converter 602 during the frame period. For example, when the peripheral light is bright, the conversion processor 603 outputs a sensing signal of '11', maintains the sensing signal of '11' outputted during one frame period while the counter 604 is counting the predetermined number. On the other hand, when the peripheral light is dark, the conversion processor 603 outputs a sensing signal of '00', maintains the sensing signal of '00' outputted during one frame period while the counter 604 is counting the predetermined number.

Furthermore, the sensing signal from the conversion processor 603 is transferred to a current controller so that the current controller determines a drive current corresponding to the sensing signal form the conversion processor 603.

The counter 604 counts to the number and a corresponding counting signal Cs. For example, in a case of the counter 604 referring a binary value of 2 bits, when the counter 604 receives a vertical synchronous signal Vsync, it is initialized with '$00_{(2)}$'. Next, the counter 604 sequentially shifts a clock signal CLK and counts to the number to '$11_{(2)}$'. When the vertical synchronous signal Vsyn is inputted to the counter 604, it is reset in an initial state. Through the aforementioned operation, the counter 604 sequentially counts from '$00_{(2)}$' to '$11_{(2)}$' during one frame period. Also, the counter 604 outputs a counting signal Cs corresponding to a counted number to the conversion processor 603.

The plurality of registers 605 are composed of first to four registers. The first register stores a first gamma compensation coefficient indicating that a brightness of the peripheral light corresponds to the outer light. The second register stores a second gamma compensation coefficient indicating that a brightness of the peripheral light corresponds to the inner light. The third register stores a third gamma compensation coefficient indicating that a brightness of the peripheral light corresponds to the dark state. The fourth register stores a four gamma compensation coefficient indicating that a brightness of the peripheral light corresponds to the darkest state.

The first selector 606 selects one of the plurality of registers 605, and selects and outputs a control signal stored in the selected register. Accordingly, when it is determined that the peripheral light is the outer light according to the sensing signal, the first selector 606 selects the first register. When it is judged that the peripheral light is the inner light according to the sensing signal, the first selector 606 selects the second register. When it is judged that the peripheral light is in the dark state according to the sensing signal, the first selector 606 selects the third register. When it is judged that the peripheral light is in the darkest state according to the sensing signal, the first selector 606 selects the fourth register.

The second selector 607 receives a set value of 1 bit for adjusting on/off from an exterior. When '1' is selected, the second selector 607 controls luminance corresponding to peripheral light so as to output a signal corresponding to an output signal of the optical sensing unit 601. When '0' is selected, the second selector 607 does not operate according to an output signal of the optical sensing unit 601, and may display images with predetermined luminance regardless of peripheral light in order to output a signal. The signal may be stored and output.

The gamma compensation circuit 608 performs a gamma compensation based on a gamma compensation coefficient included in a control signal, which is selected by the first selector 606.

Figure 4:
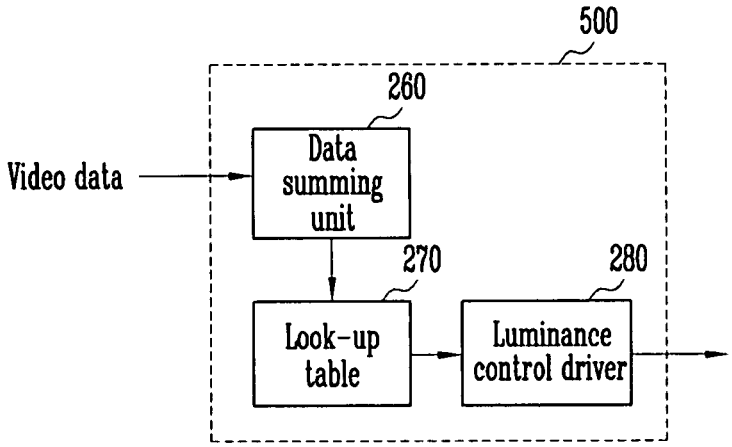
FIG. 4 is a block diagram view showing an example of a current controller used in the organic light emitting display shown in FIG. 2.

FIG. 4 is a view showing an example of a current controller used in the organic light emitting display shown in FIG. 2. With reference to FIG. 4, a drive of the current controller 500 is determined according to the sensing signal output from the conversion processor of the optical sensor shown in FIG. 3. The current controller 500 includes a data summing unit 260, a look-up table 270, and a luminance control driver 280. When the peripheral light sensed the optical sensor is the outer light or the inner light, the current controller 500 drives and limits an electric current flowing through the pixel portion. In contrast to this, when the sensed peripheral light is in the dark state or the darkest state, the current controller 500 does not limit the electric current flowing through the pixel portion.

The data summing unit 260 extracts frame data, which is obtained by summing video data having red, green, and blue information inputted thereto during the frame period. All video data during the frame period are summed to obtain frame data. When a data value of the frame data is large, there are many pixels with high luminance data. When the data value of the frame data is small, there are few pixels with high luminance data.

The look-up table 270 stores a duration of an emission period of an emission control signal according to the data value of the frame data. The width of the emission period is designated using an upper bit of the frame data. A brightness degree of the pixel portion 100 during one frame period is determined using upper 5 bits of the frame data.

Furthermore, as a size of the frame data is increased, luminance of the pixel portion 100 is gradually increased. When the luminance of the pixel portion 100 becomes greater than predetermined brightness, it is limited. As luminance of the pixel increased, a limiting rate is gradually increased to prevent an excessive luminance of the pixel portion.

Table 1 shows one example of the look-up table. An emission rate according to the number of pixels emitting light with luminance greater than a certain value is limited to 50% of a maximum value.

TABLE 1

| Upper 5 bits | Emission rate | Emission ratio | Luminance | Width of emission control signal |
|---|---|---|---|---|
| 0 | 0% | 100% | 300 | 325 |
| 1 | 4% | 100% | 300 | 325 |
| 2 | 7% | 100% | 300 | 325 |
| 3 | 11% | 100% | 300 | 325 |
| 4 | 14% | 100% | 300 | 325 |
| 5 | 18% | 100% | 300 | 325 |
| 6 | 22% | 100% | 300 | 325 |
| 7 | 25% | 100% | 300 | 325 |
| 8 | 29% | 100% | 300 | 325 |
| 9 | 33% | 100% | 300 | 325 |
| 10 | 36% | 100% | 300 | 325 |
| 11 | 40% | 99% | 297 | 322 |
| 12 | 43% | 98% | 295 | 320 |
| 13 | 47% | 96% | 287 | 311 |
| 14 | 51% | 93% | 280 | 303 |
| 15 | 54% | 89% | 268 | 290 |
| 16 | 58% | 85% | 255 | 276 |
| 17 | 61% | 81% | 242 | 262 |
| 18 | 65% | 76% | 228 | 247 |
| 19 | 69% | 72% | 217 | 235 |
| 20 | 72% | 69% | 206 | 223 |
| 21 | 76% | 65% | 196 | 212 |
| 22 | 79% | 62% | 186 | 202 |
| 23 | 83% | 60% | 179 | 194 |
| 24 | 87% | 57% | 172 | 186 |
| 25 | 90% | 55% | 165 | 179 |
| 26 | 94% | 53% | 159 | 172 |
| 27 | 98% | 51% | 152 | 165 |
| 28 | — | — | — | — |
| 29 | — | — | — | — |
| 30 | — | — | — | — |
| 31 | — | — | — | — |

When a rate of an emission area emitting light with maximal luminance is less than of equal to 36%, the luminance is not limited. In contrast to this, when the rate of an emission area exceeds 36%, the luminance is limited to increase an area emitting light with maximal luminance, a rate limiting the luminance is also increased. Furthermore, in order to prevent an excessive limit of the luminance, a maximal limited rate is set to 50%. Accordingly, although most pixels of the pixel portion 100 emit light with maximal luminance, it causes a limited rate of luminance not to be less than or equal to 50%.

Table 2 shows another example of the look-up table. An emission rate according to the number of pixels emitting light with luminance greater than a certain value is limited to 35% of a maximum value.

TABLE 2

| Upper 5 bits | Emission rate | Emission ratio | Luminance | Width of emission control signal |
|---|---|---|---|---|
| 0 | 0% | 100% | 300 | 325 |
| 1 | 4% | 100% | 300 | 325 |
| 2 | 7% | 100% | 300 | 325 |
| 3 | 11% | 100% | 300 | 325 |
| 4 | 14% | 100% | 300 | 325 |
| 5 | 18% | 99% | 298 | 322 |
| 6 | 22% | 98% | 295 | 320 |
| 7 | 25% | 95% | 285 | 309 |
| 8 | 29% | 92% | 275 | 298 |
| 9 | 33% | 88% | 263 | 284 |

TABLE 2-continued

| Upper 5 bits | Emission rate | Emission ratio | Luminance | Width of emission control signal |
|---|---|---|---|---|
| 10 | 36% | 83% | 250 | 271 |
| 11 | 40% | 79% | 237 | 257 |
| 12 | 43% | 75% | 224 | 243 |
| 13 | 47% | 70% | 209 | 226 |
| 14 | 51% | 64% | 193 | 209 |
| 15 | 54% | 61% | 182 | 197 |
| 16 | 58% | 57% | 170 | 184 |
| 17 | 61% | 53% | 160 | 173 |
| 18 | 65% | 50% | 150 | 163 |
| 19 | 69% | 48% | 143 | 155 |
| 20 | 72% | 45% | 136 | 147 |
| 21 | 76% | 43% | 130 | 141 |
| 22 | 79% | 41% | 124 | 134 |
| 23 | 83% | 40% | 119 | 128 |
| 24 | 87% | 38% | 113 | 122 |
| 25 | 90% | 36% | 109 | 118 |
| 26 | 94% | 35% | 104 | 113 |
| 27 | 98% | 34% | 101 | 109 |
| 28 | — | — | — | — |
| 29 | — | — | — | — |
| 30 | — | — | — | — |
| 31 | — | — | — | — |

When a rate of an emission area emitting light with maximal luminance is less than or equal to 34%, the luminance is not limited. In contrast to this, when the rate of an emission area exceeds 34%, the luminance is limited to increase an area emitting light with maximal luminance, a rate limiting the luminance is also increased. Furthermore, in order to prevent excessive limiting of the luminance, a maximal limited rate is set to 33%. Accordingly, although most pixels of the pixel portion 100 emit light with maximal luminance, it causes a limited rate of luminance not to be less than or equal to 33%.

The luminance control driver 280 receives the upper five bits of data and outputs a luminance control signal. The luminance control signal is input to the scan driver 400 to control it so that the scan driver 400 outputs an emission control signal according to the luminance control signal. In particular, when the scan driver 400 comprises a scan driving circuit and an emission control circuit, the luminance control signal is input to the emission control circuit, so that the emission control circuit outputs the emission control signal according to the luminance control signal.

The emission control signal has a maximum emission period of 325. Accordingly, 8 bits may be expressed in 256 patterns, and 9 bits may be expressed in 512 patterns. So as to generate the emission period of the emission control signal illustrated in table 1, the luminance control signal may output a signal of 9 bits. The luminance control signal may use a start pulse. A width of the emission control signal can be determined according to a width of the start pulse.

Figure 5:
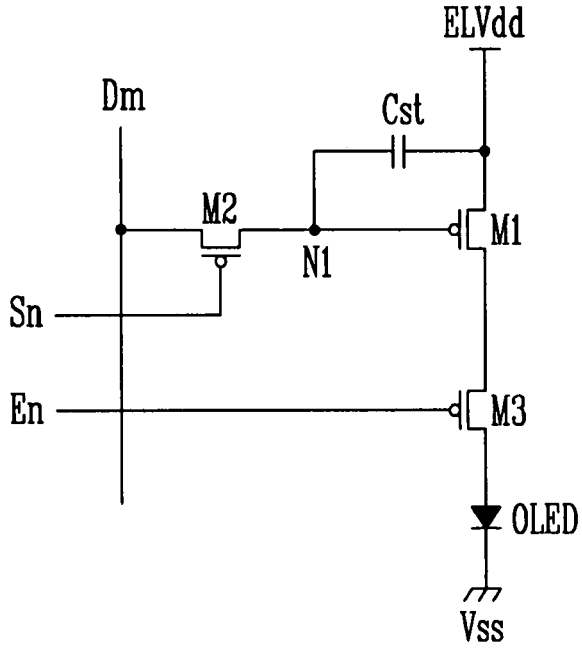
FIG. 5 is a schematic view showing an example of a pixel used in the organic light emitting display shown in FIG. 2.

FIG. 5 is a view showing an example of a pixel used in the organic light emitting display shown in FIG. 2. With reference to FIG. 5, a pixel includes an organic light emitting diode OLED and a pixel driving circuit. The pixel driving circuit includes a first transistor M1, a second transistor M2, a third transistor M3, and a capacitor Cst. Each of the first transistor M1, the second transistor M2, and the third transistor M3 includes a gate, a source and a drain. The capacitor Cst includes a first electrode and a second electrode.

A source of the first transistor M1 is connected to a power supply line ELVdd, a drain thereof is a source of the third transistor M3, and a gate thereof is connected to a first node N1. The first node N1 is connected to a drain of the second transistor M2. The first transistor M1 functions to supply an electric current corresponding to a data signal to the organic light emitting diode OLED.

A source of the second transistor M2 is connected to a data line Dm, a drain thereof is connected to the first node N1, and a gate thereof is connected to a scan line Sn. The second transistor M2 transfers the data signal to the first node N1 according to a scan signal applied to a gate thereof.

A source of the third transistor M3 is connected to the drain of the first transistor M1, a drain thereof is connected to an anode electrode of the organic light emitting diode OLED, and a gate thereof is connected to an emission control line En. The third transistor M3 responds to an emission control signal. Accordingly, according to the emission control signal, the third transistor M3 controls a flow of current from the first transistor M1 to the organic light emitting diode OLED, so that the organic light emitting diode OLED controls a light emission.

The first electrode of the capacitor Cst is connected to the power supply line ELVdd, and a second electrode thereof is connected to the first node N1. The capacitor Cst is charged with a charge according to the data signal. The capacitor Cst applies a signal to the gate of the first transistor M1 charged charge during the frame period to maintain operation of the first transistor M1 during the frame period.

Figure 6:
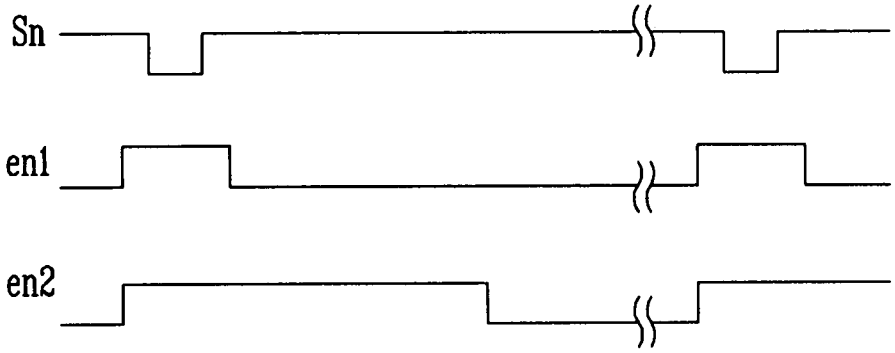
FIG. 6 is a timing diagram of signals input to the pixel shown in FIG. 5.

FIG. 6 is a timing chart of signals input to the pixel shown in FIG. 5. With reference to FIG. 6 in relation to FIG. 5, a case where a scan signal sn is input to a scan line Sn and a second emission control signal is input through an emission control line En is compared with a case where a scan signal sn is input to a scan line Sn and a first emission control signal is input through an emission control line En.

First, when the scan signal becomes a low state through the scan line Sn and the first emission control signal en1 becomes a high state, the second transistor M2 is turned on and the third transistor M3 is turned off. A data signal is transferred to the first node N1 through the second transistor M2, so that a voltage corresponding to the data signal is stored in the capacitor Cst. Further, when the scan signal becomes a high state, the voltage stored in the capacitor Cst is maintained at a gate of the first transistor M1, thereby allowing an electric current from a source of the first transistor M1 to a drain direction thereof. However, a first emission control signal en1 maintains a high state to turn off the third transistor M3. Accordingly, the electric current does not flow to the organic light emitting diode OLED. Further, when the first emission control signal en1 becomes a low state, the third transistor M3 is turned on to allow the electric current to flow to the organic light emitting diode OLED, with the result that the organic light emitting diode OLED emits light.

When the second emission control signal en1 having a high state longer than that of the first emission control signal en1 is input, a cut off time of a current flow transferred to the organic light emitting diode OLED is increased. Accordingly, an emission time of the organic light emitting diode OLED is reduced to lower the luminance.

As a result, the luminance is controlled by adjusting a pulse width of the emission control signals en1 and en2.

Figure 7:
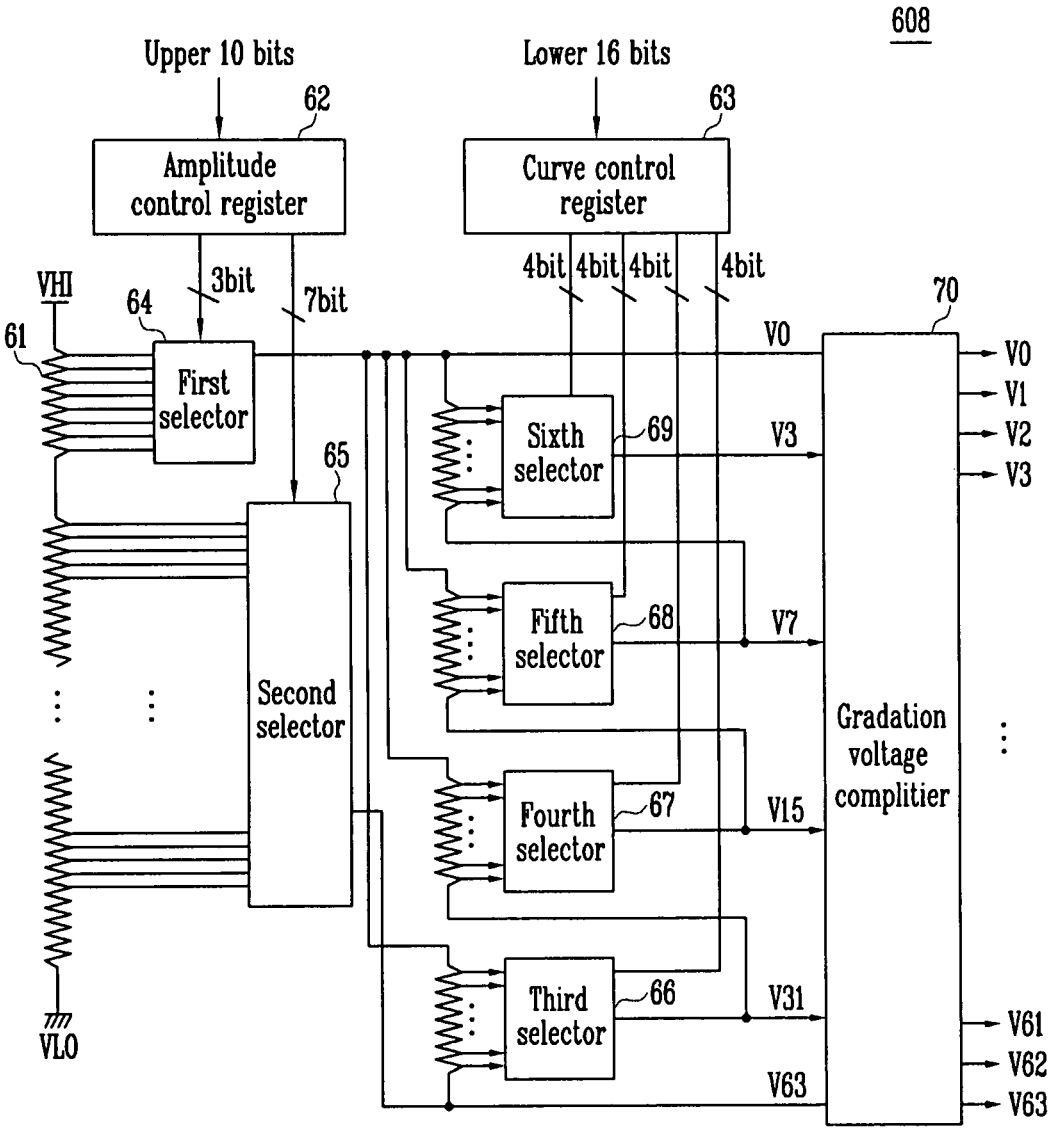
FIG. 7 is a schematic diagram showing a gamma compensation circuit connected to an optical sensor shown in FIG. 3.

FIG. 7 is a circuit diagram showing a gamma compensation circuit connected to an optical sensor shown in FIG. 3. Referring to FIG. 7, the gamma compensation circuit 608 includes a ladder resistor 61, an amplitude control register 62, a curve control register 63, a first selector 61 to a sixth selector 69, and a gradation voltage amplifier 70.

The ladder resistor 61 includes a plurality of variable resistors serially connected to each other between the lowest level voltage VLO and a reference voltage. In this embodiment, the highest level voltage VHI supplied from an exterior is set as the reference voltage. A plurality of gradation voltages are generated through the ladder resistor 61. When the ladder resistor 61 has a small resistance, an amplitude control range may be narrower but control precision is enhanced. In contrast to this, when the ladder resistor 61 has a large resistance, the amplitude control range may be wider but control precision is deteriorated.

The amplitude control register 62 outputs a register set value of 3 bits to the first selector 64, and outputs a register set value of 7 bits to the second selector 65. Here, the number of selective gradations is increased by increasing the number of set bits. Further, by changing the register set value, a gradation voltage can be differently selected.

The curve control register 63 outputs a register set value of 4 bits to the third selector 66 to sixth selector 69. Here, the register set value can be changed, and a selective gradation voltage can be adjusted according to the register set value.

Upper 10 bits of the gamma compensation coefficient of a control signal stored in the plurality of registers 605 are input to the amplitude control register 62, and the lower 16 bits thereof are input to the curve control register 63, so that they are selected as a register set value.

The first selector 64 selects a gradation voltage corresponding to a register set value of 3 bits set by the amplitude control register 62 among a plurality of gradation voltages divided through the ladder resistor 61, and outputs it as a most significant bit gradation voltage.

The second selector 65 selects a second gradation voltage corresponding to a register set value of 7 bits set by the amplitude control register 62 among a plurality of gradation voltages divided through the ladder resistor 61, and outputs it as a least significant bit gradation voltage.

The third selector 66 divides a voltage between the first gradation voltage from the first selector 64 and the second gradation voltage from the second selector 65 into a plurality of gradation voltages through a plurality of resistor rows, and selects and outputs a third gradation voltage corresponding to a register set value of 4 bits.

The fourth selector 67 divides a voltage between the first gradation voltage from the first selector 64 and the third gradation voltage from the third selector 66 into a plurality of gradation voltages through a plurality of resistor rows, and selects and outputs a fourth gradation voltage corresponding to a register set value of 4 bits.

The fifth selector 68 selects and outputs one of the first to fourth gradation voltages from the first to fourth selectors 64 to 67 corresponding to a register set value of 4 bits.

The sixth selector 69 selects and outputs one of the first to fifth gradation voltages from the first to fifth selectors 64 to 68 corresponding to a register set value of 4 bits. The aforementioned operation, a curve of an intermediate gradation unit can be adjusted according to a register set value of the curve control register 63, so that gamma characteristics can be easily adjusted according to respective characteristics of light emitting diodes. Furthermore, so as to make a gamma curve characteristic to be convex downwardly, a resistance of each ladder resistor 61 is set to increase a potential difference between gradations as a small gradation is displayed. In contrast to this, in order to make a gamma curve characteristic to be concave downwardly, a resistance of each ladder resistor 61 is set to reduce a potential difference between gradations as a small gradation is displayed.

The gradation voltage amplifier 70 outputs a plurality of voltages corresponding to a plurality of luminances to be displayed on the pixel portion 100. FIG. 5 shows an output of a voltage corresponding to luminance 64.

Gamma compensation circuits by R, G, and B groups are set so that R, G, and B obtain the same luminance characteristics in consideration of a variation in characteristics of R, G, and B light emitting diodes. Accordingly, through the aforementioned operations, the amplitude and the curve by R, G, and B can be adjusted through the curve control register 63 and the amplitude control register 62.

In the organic light emitting display and the method for driving the same according to the presented embodiments, luminance is controlled corresponding to the brightness of peripheral light. When the peripheral light is greater than a certain brightness, the amplitude of current flowing through a pixel is reduced to reduce luminance, with the result that power consumption can be reduced.

Although a few embodiments of the present invention have been shown and described, it would be appreciated by those skilled in the art that changes might be made without departing from the principles and spirit of the invention.

What is claimed is:

1. An organic light emitting display, comprising:

a pixel portion comprising a plurality of pixels, configured to receive a plurality of scan signals, a plurality of emission control signals, and a plurality of data signals in order to display images according to video data, wherein each pixel is configured to generate light for a duration during each frame, wherein the duration is determined by at least a portion of the received signals;

a data driver configured to generate and transfer the plurality of data signals to the pixel portion using the video data;

a scan driver configured to transfer the plurality of scan signals and the plurality of emission control signals to the pixel portion;

an optical sensor configured to detect ambient light and to generate a sensing signal to control luminance of the pixel portion according to the detected ambient light;

a current controller configured to, as a result of the ambient light having a detected luminance greater than a level, cause the pixels to generate light for a reduced duration during each frame, wherein the reduced duration is determined according to a sum of the video data inputted during each frame; and a gamma compensation circuit, configured to provide gamma correction according to one of a plurality of selectable registers, wherein the registers are selected according to the ambient light detected by the optical sensor, wherein the sensing signal controls both the scan driver and the register selection, and wherein the sensing signal controls the scan driver via the current controller while controlling register selection for the gamma compensation circuit.

2. The organic light emitting display as claimed in claim 1, wherein the optical sensor comprises:

an optical sensing unit configured to output an analog sensing signal corresponding to a brightness of ambient light;

an analog-digital converter configured to convert the analog sensing signal into a digital sensing signal;

a counter configured to count to a number during one frame period to generate a counting signal;

a conversion processor configured to output a control signal according to the digital sensing signal and the counting signal;

a plurality of registers configured to categorize the brightness of the ambient light into one of a plurality of levels, and to store a plurality of register values corresponding to the plurality of levels; and a first selecting unit configured to select one of the plurality of registers according to the control signal from the conversion processor and to output one of the plurality of register values in the registers.

3. The organic light emitting display as claimed in claim 2, wherein the analog-digital converter is configured to compare the analog sensing signal with a reference voltage to generate the digital sensing signal.

4. The organic light emitting display as claimed in claim 3, wherein the reference voltage varies according to the brightness of the ambient light.

5. The organic light emitting display as claimed in claim 2, wherein the current controller is connected to the conversion processor, and a current of the current controller is determined based at least in part on the control signal from the conversion processor.

6. The organic light emitting display as claimed in claim 2, wherein the first selecting unit controls a ratio of the luminance.

7. The organic light emitting display as claimed in claim 6, wherein the gamma compensation circuit comprises:

an amplitude control register configured to control an upper level voltage and a lower level voltage according to a register bit;

a curve control register configured to select an intermediate level voltage according to the register bit to control a gamma curve;

a first selector configured to select the upper level voltage according to the register bit;

a second selector configured to select the lower level voltage according to the register bit;

third to sixth selectors configured to output an intermediate level voltage according to the register bit; and a voltage amplifier configured to output a plurality of voltages corresponding to a plurality of luminances to be displayed.

8. The organic light emitting display as claimed in claim 7, wherein a second selecting unit is between the first selecting unit and the gamma compensation circuit, and is configured to select and transfer one of a signal from the first selecting unit and a separate signal to the gamma compensation circuit.

9. The organic light emitting display as claimed in claim 1, wherein the current controller includes:

a data summing unit configured to sum data signals input thereto;

a look-up table configured to store luminance values corresponding to the sum of the data signals; and a luminance controller configured to receive a luminance value from the look-up table and to control an emission time of the pixel portion based on the luminance value.

10. The organic light emitting display as claimed in claim 9, wherein the emission time of the pixel portion corresponds to a pulse width of the emission control signal.

11. The organic light emitting display as claimed in claim 1, wherein the optical sensor is configured to shut off a current control of the current controller when the ambient light has a value less than a level.

* * * * *